US009402490B2

(12) United States Patent
Johnson

(10) Patent No.: US 9,402,490 B2
(45) Date of Patent: Aug. 2, 2016

(54) CAKE SHIELD WITH LID

(71) Applicant: Clara Johnson, Shreveport, LA (US)

(72) Inventor: Clara Johnson, Shreveport, LA (US)

( * ) Notice: Subject to any disclaimer, the term of this patent is extended or adjusted under 35 U.S.C. 154(b) by 0 days.

(21) Appl. No.: 14/263,278

(22) Filed: Apr. 28, 2014

(65) Prior Publication Data

US 2014/0224798 A1 Aug. 14, 2014

Related U.S. Application Data

(60) Provisional application No. 61/917,686, filed on Dec. 18, 2013.

(51) Int. Cl.
*A47G 19/26* (2006.01)
*A47G 19/00* (2006.01)

(52) U.S. Cl.
CPC ..... *A47G 19/26* (2013.01); *A47G 19/00* (2013.01); *A47G 2200/08* (2013.01); *A47G 2400/061* (2013.01)

(58) Field of Classification Search
CPC ... A47G 19/00; A47G 19/26; A47G 2200/08; A47G 2400/061
USPC ..... 220/212; 99/645; 206/457, 227, 527; 431/253, 295, 296
See application file for complete search history.

(56) References Cited

U.S. PATENT DOCUMENTS

| | | | | | |
|---|---|---|---|---|---|
| 4,884,966 | A * | 12/1989 | Wexler | 431/295 |
| D627,190 | S * | 11/2010 | Fain | D7/368 |
| 8,459,456 | B2 | 6/2013 | Donnelly | |
| 2003/0136277 | A1 | 7/2003 | Okros | |
| 2004/0224271 | A1 | 11/2004 | Langsam | |
| 2005/0087459 | A1* | 4/2005 | Slagter | 206/227 |
| 2009/0181335 | A1 | 7/2009 | Tropeano | |
| 2012/0247996 | A1* | 10/2012 | Donnelly | 206/457 |

* cited by examiner

*Primary Examiner* — Fenn Mathew
*Assistant Examiner* — Elizabeth Volz
(74) *Attorney, Agent, or Firm* — Daniel Boudwin; Global Intellectual Property Agency

(57) ABSTRACT

Provided is a cake shield for protecting cakes and baked goods from airborne contaminants. The cake shield has a cover portion that houses a cake, and a lid that fits over the cover portion. A plurality of apertures is disposed along the upper wall of the cover portion. Candles and decorative elements are inserted through these apertures into the underlying cake. Thus, when a user blows out his or her birthday candles, their exhalation is largely blocked by the cover portion, and does not reach the cake surface. When the cake is no longer in use, the lid is placed over the cover portion and rest thereon. The lid covers the apertures, preventing dust and debris form falling on the cake while it is stored.

6 Claims, 2 Drawing Sheets

CAKE SHIELD WITH LID

CROSS REFERENCE TO RELATED APPLICATION

This application claims the benefit of U.S. Provisional Application No. 61/917,686 filed on Dec. 18, 2013. The above identified patent application is herein incorporated by reference in its entirety to provide continuity of disclosure.

BACKGROUND OF THE INVENTION

1. Field of the Invention

The present invention relates to bake ware accessories. More specifically, it relates to a transparent cover for a cake, cupcakes, or other bake goods. The shield has a number of apertures in its upper wall that enable placement of cake candles through the shield and into the underlying baked goods. When the candles are blown out, as occurs during birthday parties, the shield protects the underlying baked goods from bacteria and germs, while still enabling access to the lighted candles.

It is a long-standing tradition that the person for whom a birthday party is thrown, will blow out a set of lit candles placed on a birthday cake. Often the cake has frosting applied in ornately decorative patterns, with candles and adornments to match. When the appropriate time arrives, partygoers will turn out the lights, and the cake, with candles lit, is presented to the birthday boy or girl. It is customary to close your eyes, make a wish, and exhale strongly in an attempt to blow out all the candles with a single breath. The belief is that if the person is able to blow out all the candles with a single exhalation, then their wish will come true.

While the blowing out of birthday candles is a fun and whimsical act for birthday celebrants, it carries the risk of potential harm to the other partygoers. Each exhalation by the candle blower sprays small droplets of saliva across the birthday cake surface. If the birthday celebrant is sick, he or she may inadvertently spread germs across the cake surface, where other partygoers can ingest the germs. In this way, the good intentioned practice of an age-old tradition provides a conduit for transmission of saliva borne disease.

A solution is needed that enables the blowing out of birthday candles while still protecting an underlying cake from the spray of germs. The present invention solves this problem with a cake shield that has apertures of different sizes in its upper wall. Candles and decorations are inserted through the apertures into the cake. This provides access to the lit portion of the candles, while still covering substantial portions of the cake.

2. Description of the Prior Art

Devices have been disclosed in the prior art that relate to baked goods covers. These include devices that have been patented and published in patent application publications. These devices generally relate to cake shields. The following is a list of devices deemed most relevant to the present disclosure, which are herein described for the purposes of highlighting and differentiating the unique aspects of the present invention, and further highlighting the drawbacks existing in the prior art.

A cake shield with an aperture is disclosed in Langsam, U.S. Patent Application Publication No. 2004/0224271. The Langsam device is a disposable cake shield made form plastic or cardboard. It has a plurality of small legs that rest upon the upper surface of a cake when in use. A central opening or window extends across a central portion of the shield, enabling insertion and removal of candles. One side of the shield has a raised, sloped portion that shields part of the candles. Users slow towards this raised portion, thereby reducing the likelihood that germs will fall onto the cake through the window. Unlike the present invention, the Langsam device does not have four sidewalls to protect other parts of the cake.

Okros, U.S. Patent Application Publication No. 2003/0136277, teaches a cake shield with no apertures. The Okros shield has a plurality of recesses in the shield to permit the placement of candles within the shield. A placard tray, or letter holding slot is provided along the exterior of a shield bottom for holding letters and message placards. Unlike the present invention, the Okros device does not have apertures of varied sizes to accommodate different types of candles and decorations.

Another variation on the cake shield is disclosed by Donnelly, U.S. Pat. No. 8,459,456. The Donnelly device has several parts that assemble to form a cake shield. The top is a planar surface filled with apertures for candles. This top attaches to a ring disposed on or attaching to a sidewall(s). The sidewalls in turn are removably secured to a cake shield bottom once a cake is in position. The top is inserted along with candles, to help protect the cake from germs during the blowing out of candles. The top can be removed after candles are blown out to provide access to the underlying cake or cupcakes. The present invention does not have removable parts, which could disengage and fall into the cake at inopportune times.

Tropeano, U.S. patent Application Publication No. 2009/0181335 discloses a cake shield having an upper portion and a lid. The upper portion has a top wall and at least one sidewall. The top wall has a plurality of apertures disposed therethrough. A planar bottom supports a cake and attaches to the upper portion. This device does not have a removable lid that covers the apertures when in place. The present invention has such a lid to present dust and debris from falling through the apertures.

These prior art devices have several known drawbacks. They do not teach a removable lid that sits onto the upper portion of the cake shield. The present invention teaches a cake shield with a lid that removably secures through apertures in the upper portion of the cake shield. It substantially diverges in design elements from the prior art and consequently it is clear that there is a need in the art for an improvement to existing cake shield devices. In this regard the instant invention substantially fulfills these needs.

SUMMARY OF THE INVENTION

In view of the foregoing disadvantages inherent in the known types of cake shields now present in the prior art, the present invention provides a new removable lid wherein the same can be utilized for providing convenience for the user when protecting a cake in between uses.

The present invention is a cake shield that sits over and around a cake or set of baked goods. The shield has a lid and a cake cover. Cake covers may have a variety of shapes and sizing options in order to accommodate the diversity of confections available on the market. The cake cover itself has at least one sidewall, and a top wall. The space between the walls is hollow to accommodate a cake or set of baked goods. A number of apertures of different sizes are disposed throughout the upper wall. These apertures are sized to accommodate birthday candles such as the standard skinny vertical candles, and the large numeral shaped candles. Decorative items connected to vertical sticks The lid is planar with a handle protruding form an upper surface. Several connection points, such as pegs, removably secure the lid to the cover. For example, small pegs extending downward from the lid may engage with the apertures in the cover, or may simply sit therein. This feature enables greater protection of the cake in between eating sessions, because the lid prevents dust and debris from falling onto the cake through the apertures.

It is therefore an object of the present invention to provide a new and improved cake shield device that has all of the advantages of the prior art and none of the disadvantages.

It is another object of the present invention to provide a cake shield that reduces the likelihood that germs will fall on a birthday cake during a candle blowing-out session.

Another object of the present invention is to provide a cake shield that does not impede placement of birthday candles, and decorative accents.

Yet another object of the present invention is to provide cake shield that has a removable lid to offer increased protection to a cake when not in use.

Still another object of the present invention is to provide a cake shield that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
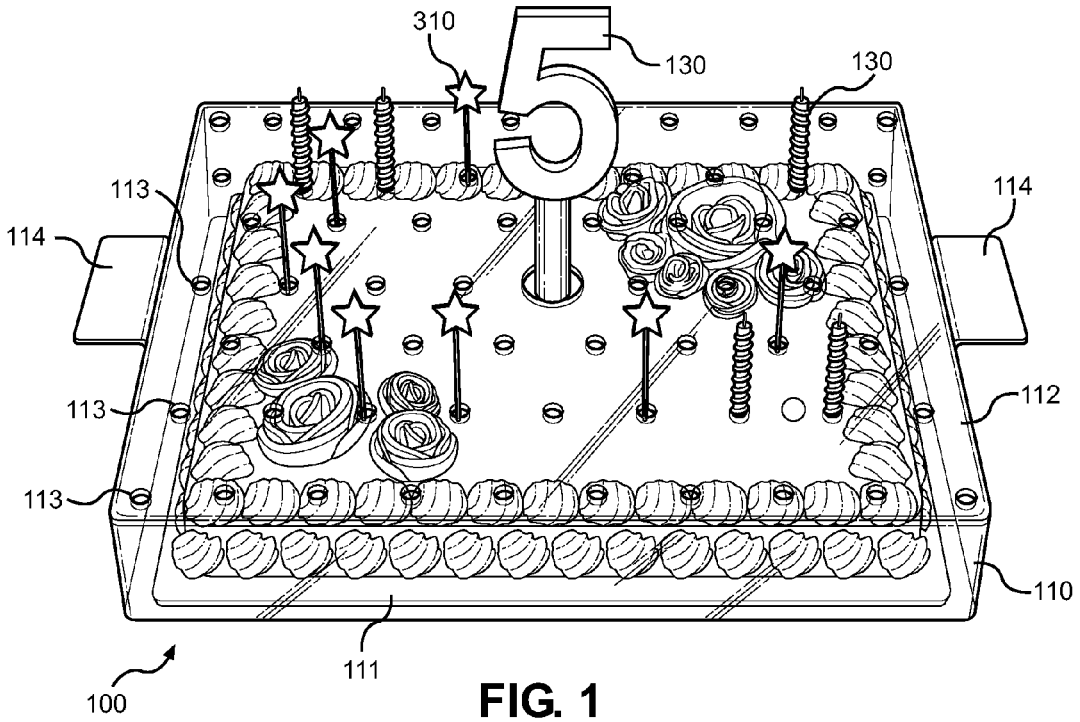
FIG. 1 shows an overhead perspective view of the cover portion of the cake shield in use. Candles and decorations are inserted through the apertures in the cover portion into the cake.

Reference is made herein to the attached drawings. Like reference numerals are used throughout the drawings to depict like or similar elements of the cake shield. For the purposes of presenting a brief and clear description of the present invention, the preferred embodiment will be discussed as used for protecting cakes and baked goods from the spread of germs. The figures are intended for representative purposes only and should not be considered to be limiting in any respect.

Figure 2:
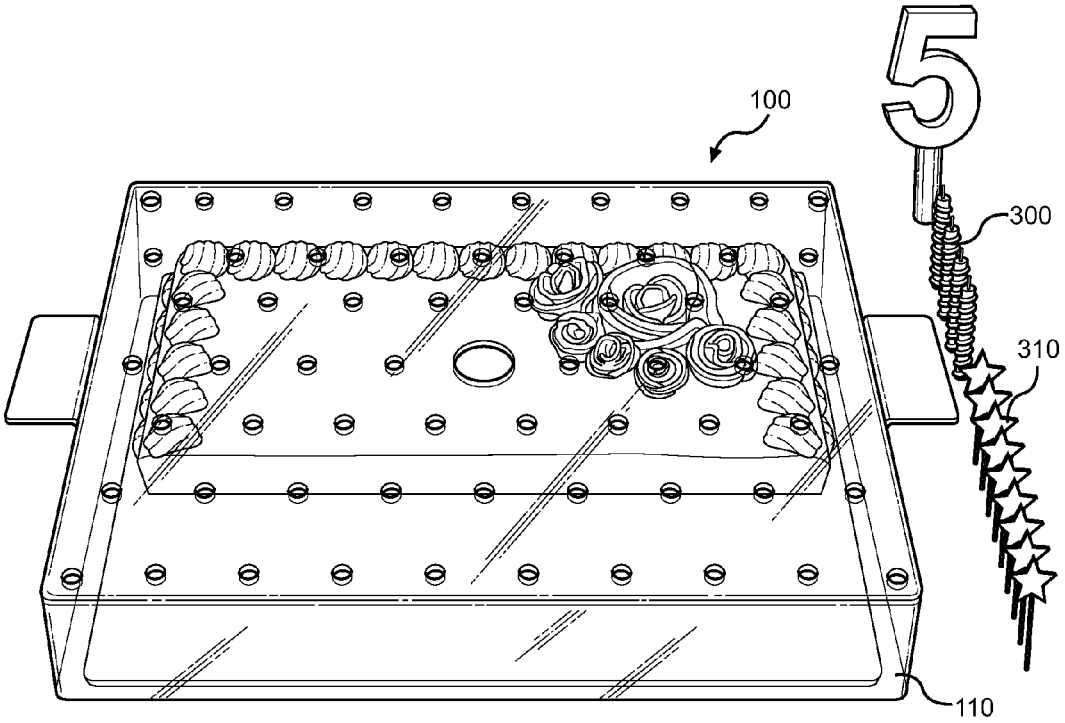
FIG. 2 shows an overhead perspective view of the cake shield in a stowed configuration with the lid secured to the upper wall of the cover portion.

Referring now to FIGS. 1 and 2, there is shown a cake shield 100. The cake shield has a cover portion 110 and a lid (not shown). A birthday cake is positioned underneath the cover portion and is enclosed by the cake shield's sidewalls 111 and upper wall 112. Several apertures 113 extend through the upper wall. These apertures have varied diameter in order to accommodate different sizes of birthday candles 300. Candles and decorative elements 310 are inserted through the apertures and into the underlying cake. Uppermost portions of the candles and decorative elements are exposed above the upper wall, in order to provide a user access to the candlewicks.

Access to candlewicks is an important feature of the present invention as it enables users to light the candles, as well as to blow the lit candles out. Some cake shields impede the placement and positioning of candles, making it difficult for partygoers to engage in traditional candle-lowing activities. In the illustrated embodiment, the apertures are disposed in a grid-like configuration. Smaller apertures are disposed across the upper wall, while larger apertures are centrally located. These larger apertures are ideal for use with novelty candles such as numerical or animal shaped candles, which have broad bases. Some embodiments of the device may feature additional large apertures at various points around the upper wall of the cover portion. Apertures may have any geometric shape, and are not limited to the circular cutouts shown in the illustrations.

Decorative elements, such as sparklers, or small accents secured to a wire stake, may be inserted into the cake in the same manner as candles. In environments where the use of open flame is prohibited, decorative elements may be used to add whimsy to a cake. The stake portion of the decorative element is inserted through an aperture and into the underlying cake. All candles and decorative elements are removed prior to lifting the cake shield, and serving the cake.

Handles 114 may optionally protrude from any portion of the sidewall exterior. By way of example, two handles may extend outward from two laterally opposing sidewalls. Alternatively, the handles may be recessed regions in which a user can fit his or her fingers in order to gain purchase on the cover portion. Inclusion of handles is preferred as it enables easy lifting of the cover portion and reduces the likelihood that the cover will collide with the underlying cake during removal.

Figure 3:
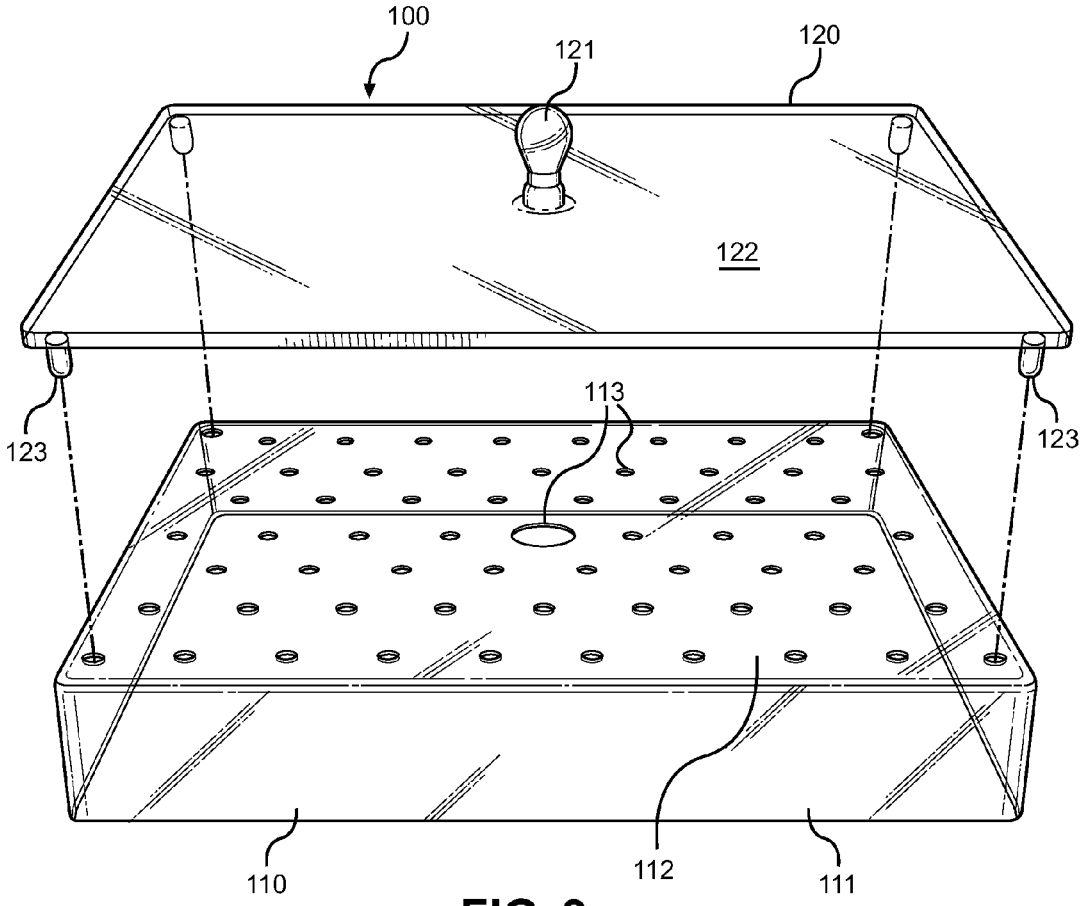
FIG. 3 shows an overhead perspective view of the cake shield with the lid in transit onto the cover portion.

Turning now to FIG. 3, there is shown a cake shield 100 with an attached lid 120. In use, the lid rests upon the cover portion 110, which houses a partially eaten birthday cake. The lid is planar with a handle 121 disposed on and extending from the upper surface 122 of the lid. In some embodiments the lid may have a smooth lower surface (not shown) that rests on the cover portion, without attaching thereto. It is preferred that an attachment means be provided to enable removable securement of the lid to the cover portion. This prevents the lid from sliding off the upper wall of the cover portion during transit.

When the lid is in place, the cake shield is in a stowed configuration. The lid lies over the top of the apertures in the cover portion, thereby preventing dust and debris from falling through the apertures onto the cake. For this reason, the lid is preferably a solid sheet of material without perforations or apertures. The lid is highly beneficial when the cake or baked goods are in transit, and the risk of exposure to rain or airborne debris is likely.

To gain access to the apertures of the cover portion, and the underlying cake, the user simply lifts up on the lid to expose the cover portion. As depicted in FIG. 3, the lid 120 is easily removed from the cover portion 110. A preferred embodiment of the lid includes an attachment means such as pegs 123 that extend down form the lower surface (not shown) of the lid. These pegs fit through apertures 113 in the cover portion. This stops the lid from sliding around, while still allowing it to be easily removable. Other attachment means such as snaps, magnets, sliding channels and the like are also contemplated.

In some embodiments, the cover portion may have small knobs or feet disposed at the corners of the sidewall lower edges. These feet raise the cover portion up away from the plate or other cake support. In this manner, the height of the cake shield is increased, and the likelihood the shield will mash down on the cake is decreased. This feature may be highly desirable in situations where the cake is a wedding cake, or other artfully decorated confection.

The present invention is a cake shield that provides a cover having a planar upper wall to black germs and dust from contacting an underlying cake. The cover upper wall has apertures designed to receive candles of various sizes, thereby allowing a user access to the candlewicks without exposing large portions of the cake surface. As a result, users can blow out birthday candles without exposing most of the birthday cake to the celebrant's saliva.

The cake shield may be made from glass or plastic or any other transparent solid material. It may have a variety of shapes and sizes, so long as the basic structure is employed It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cake shield device, comprising:

a cover portion having at least one sidewall and an upper wall, defining a hollow interior thereunder, and wherein said upper wall has a plurality of apertures disposed therethrough;

a lid, wherein said lid has an upper surface and a lower surface;

wherein the lid is solid with no apertures therethrough;

wherein said plurality of apertures comprises corner apertures disposed at corners of said cover portion such that said corner apertures align with pegs disposed along said lower surface of said lid.

2. The cake shield of claim 1, wherein said plurality of apertures comprises varied diameters to accommodate different sizes of candles.

3. The cake shield of claim 1, wherein said plurality of apertures is arranged in a grid configuration.

4. The cake shield of claim 1, wherein said cover portion further comprises handles.

5. The cake shield of claim 1, wherein said lid is removably securable to said cover portion.

6. The cake shield of claim 1, further comprising:

a peg on each corner of said lower surface of said lid;

wherein each of said peg is adapted to be inserted into one of said plurality of apertures.

* * * * *